US005960659A

United States Patent [19]

Hartman et al.

[11] Patent Number: 5,960,659

[45] **Date of Patent: *Oct. 5, 1999**

[54] SYSTEMS AND METHODS FOR MAKING DECORATIVE SHAPED METAL CANS

[75] Inventors: Mark W. Hartman, Lambertville, N.J.; Zeev W. Shore, Hazel Crest, Ill.; James J. Tang, Palatine, Ill.; Anton A. Aschberger, Downers Grove, Ill.; Michael R. Gogola, Oak Forest, Ill.; William O. Irvine, Chicago, Ill.; Ralph J. Trnka, Tinley Park, Ill.; Richard O. Wahler, Palatine, Ill.; Robert A. Winkless, Oak Lawn, Ill.

[73] Assignee: Crown Cork & Seal Company, Inc., Philadelphia, Pa.

[ * ] Notice: This patent is subject to a terminal disclaimer.

[21] Appl. No.: 09/025,609

[22] Filed: Feb. 18, 1998

Related U.S. Application Data

[63] Continuation of application No. 08/551,073, Dec. 12, 1995, Pat. No. 5,746,080, which is a continuation-in-part of application No. 08/542,422, Nov. 16, 1995, abandoned

[60] Provisional application No. 60/004,679, Oct. 2, 1995.

[51] Int. Cl.[6] ..... B21D 26/02

[52] U.S. Cl. ..... 72/61; 72/342.94; 72/348

[58] Field of Search ..... 72/57, 60, 61, 72/342.6, 342.94, 347, 348

[56] References Cited

U.S. PATENT DOCUMENTS

| | | | |
|---|---|---|---|
| D. 356,501 | 3/1995 | Kornick et al. | D9/518 |
| 840,091 | 1/1907 | Schumacher et al. | 72/58 |
| 2,083,943 | 6/1937 | Clifford | 113/116 |
| 2,748,464 | 6/1956 | Kaul | 29/535 |
| 2,980,993 | 4/1961 | Lyon | 29/534 |
| 3,029,667 | 4/1962 | Sporck | 80/5 |
| 3,040,684 | 6/1962 | Hillgren | 113/44 |
| 3,224,239 | 12/1965 | Hansson | 72/62 |
| 3,335,590 | 8/1967 | Early | 72/58 |
| 3,461,699 | 8/1969 | Roth | 72/56 |

(List continued on next page.)

FOREIGN PATENT DOCUMENTS

| | | |
|---|---|---|
| 521 637 B1 | 1/1993 | European Pat. Off. . |
| 543 695 A1 | 5/1993 | European Pat. Off. . |
| 2667521 | 4/1992 | France . |
| 1 031 257 | 9/1953 | Germany . |

(List continued on next page.)

OTHER PUBLICATIONS

Frederic Swing Crispen, C.E. "Dictionary of Technical Terms" Bruce Publishing p. 16 (1946).

*Primary Examiner*—David Jones
*Attorney, Agent, or Firm*—Woodcock Washburn Kurtz Mackiewicz & Norris LLP

[57] ABSTRACT

A method of manufacturing a metallic can body that is shaped distinctively in order to enhance its visual presentation to consumers includes, in one embodiment, steps of providing a can body blank that has a sidewall that is of a substantially constant diameter; providing a mold unit that has at least one mold wall that defines a mold cavity that is shaped generally like the can body blank, the mold wall having a pattern formed therein that corresponds to a desired final shape of the can body; positioning the can body blank within the mold cavity; and supplying a pressurized fluid into the mold cavity so that the can body blank is forced by pressure against the mold wall, causing the can body blank to assume the desired final shape of the can body. A second embodiment includes steps of radially deforming the can body blank in selected areas by selected amounts to achieve an intermediate can body that is radially modified, but is still symmetrical about its axis; and superimposing a preselected pattern of mechanical deformations that have an axial component onto the intermediate can body. Related systems and processes are also disclosed.

9 Claims, 5 Drawing Sheets

U.S. PATENT DOCUMENTS

| | | | |
|---|---|---|---|
| 3,610,018 | 10/1971 | Swanson et al. | 72/348 |
| 3,757,555 | 9/1973 | Blutt et al. | 72/63 |
| 3,759,203 | 9/1973 | Frankenberg | 413/69 |
| 3,831,416 | 8/1974 | Wolfe | 72/117 |
| 3,896,648 | 7/1975 | Schertenleib | 72/61 |
| 3,911,707 | 10/1975 | Minakov et al. | 72/76 |
| 4,055,064 | 10/1977 | Schow | 72/118 |
| 4,289,007 | 9/1981 | Kraft | 72/58 |
| 4,414,834 | 11/1983 | Gratzer et al. | 72/58 |
| 4,827,747 | 5/1989 | Okada et al. | 72/59 |
| 4,947,667 | 8/1990 | Gunkel et al. | 72/56 |
| 5,040,682 | 8/1991 | Palisin, Jr. et al. | 413/69 |
| 5,058,408 | 10/1991 | Leftault, Jr. et al. | 72/56 |
| 5,187,962 | 2/1993 | Bilko et al. | 72/62 |
| 5,214,948 | 6/1993 | Sanders et al. | 72/58 |
| 5,261,261 | 11/1993 | Ramsey | 72/105 |
| 5,261,558 | 11/1993 | Claydon | 220/671 |
| 5,326,250 | 7/1994 | Doudement | 425/541 |
| 5,334,007 | 8/1994 | Denis et al. | 425/526 |
| 5,338,181 | 8/1994 | Denis et al. | 425/526 |
| 5,342,558 | 8/1994 | Denis et al. | 264/25 |
| 5,622,070 | 4/1997 | Bulso, Jr. | 72/68 |
| 5,746,080 | 5/1998 | Hartman et al. | 72/61 |

FOREIGN PATENT DOCUMENTS

| | | |
|---|---|---|
| 971981 | 1/1997 | Japan . |
| 388 887 | 3/1965 | Switzerland . |
| 1570820 | 6/1990 | U.S.S.R. . |
| 1755992A1 | 8/1992 | U.S.S.R. . |
| 216 704 | 6/1924 | United Kingdom . |
| 1 279 421 | 6/1972 | United Kingdom . |
| 1 309 695 | 3/1973 | United Kingdom . |
| 2 003 416 | 3/1979 | United Kingdom . |
| 2 123 329 | 2/1984 | United Kingdom . |
| 2 120 148 | 7/1985 | United Kingdom . |
| 2 224 965 | 5/1990 | United Kingdom . |
| 2 257 073 | 1/1993 | United Kingdom . |
| 2 266 290 | 10/1993 | United Kingdom . |
| WO 83/01916 | 6/1983 | WIPO . |
| WO 92/13653 | 8/1992 | WIPO . |
| WO 95/08410 | 3/1995 | WIPO . |
| WO 95/15227 | 6/1995 | WIPO . |
| WO 97/12704 | 4/1997 | WIPO . |
| WO 97/12705 | 4/1997 | WIPO . |
| WO 97/12706 | 4/1997 | WIPO . |

SYSTEMS AND METHODS FOR MAKING DECORATIVE SHAPED METAL CANS

This Application is a continuation of application Ser. No. 08/551,073 filed Dec. 12, 1995, now U.S. Pat. No. 5,746,080 which is a continuaion-in-part of U.S. Ser. No. 08/542,422 filed Nov. 16, 1995, now abandoned, which in turn claims §119(e) priority based on provisional application 60/004,679, filed on Oct. 2, 1995, now abandoned. Each of these documents are incorporated by reference as if set forth fully herein.

BACKGROUND OF THE INVENTION

1. Field of the Invention

This invention relates generally to the field of consumer packaging, and more specifically to metal cans, such as the steel and aluminum cans that are commonly used for packaging soft drinks, other beverages, food and aerosol products.

2. Description of the Prior Art and Recent Technology

Metal cans for soft drinks, other beverages and other materials are of course in wide use in North America and throughout the world. The assignee of this invention, Crown Cork & Seal Company of Philadelphia, is the world's largest designer and manufacturer of such cans.

The art of making and packing metal cans is constantly evolving in response to improved technology, new materials, and improved manufacturing techniques. Other forces driving the evolution of technology in this area include raw material prices, the nature of new materials to be packaged and the marketing goals of the large companies that manufacture and distribute consumer products such as soft drinks.

Interest has existed for some time for a metal container that is shaped differently than the standard cylindrical can in such a distinctive way to become part of the product's trade dress, or to be otherwise indicative of the source or the nature of the product. To the inventors best knowledge, however, no one has yet developed a practical technique for manufacturing such an irregularly shaped can at the volume and speed that would be required to actually introduce such a product into the marketplace.

Attempts have been made to manufacture shaped cans. Several decades ago, perhaps in the 1960's or early 1970's, Continental Can Company was reputed to have developed a technique for steel cans that involved expanding a rubber mandrel or balloon that is inserted into the can shell, which caused the can shell to expand against an outer mold. Diadavantages of this method include limited balloon lifetime, limited production speed, and a relatively high level of complexity.

More recently, Carnaud MetalBox PLC has developed a technique for shaping metal cans that involves placing the unshaped can in a die and then causing combustion to take place in the can. The intense heat and pressure of the combustion drives the sidewall of the can against the die, shaping the can. Disadvantages include the production of combustion by-products, and the possibility of fire risk at the production site.

A need exists for an improved system and process for manufacturing a shaped metal can, that is effective, efficient and inexpensive, especially when compared to technology that has been heretofore developed for such purposes.

SUMMARY OF THE INVENTION

Accordingly, it is an object of the invention to provide an improved system and process for manufacturing a shaped metal can that is effective, efficient and inexpensive, especially when compared to technology that has been heretofore developed for such purposes.

In order to achieve the above and other objects of the invention, a metallic can body that is decorated and shaped distinctively in order to enhance its visual presentation to consumers includes a bottom; a sidewall that is configured to substantially deviate from a standard cylindrical can body shape, the sidewall having areas where accentuation of such deviation is desired; and decoration on an external surface of the sidewall, the decoration being of a type that accentuates the areas on the sidewall where accentuation of deviation is desired, whereby the can body will have a visual impact on a consumer that is beyond what could have been achieved with only physical deviations from the standard cylindrical shape.

According to a second aspect of the invention, a method of manufacturing a metallic can body that is shaped distinctively in order to enhance its visual presentation to consumers, includes steps of (a) providing a can body blank that has a sidewall that is of a substantially constant diameter; (b) providing a mold unit that has at least one mold wall that defines a mold cavity that is shaped generally like the can body blank, the mold wall having a pattern formed therein that corresponds to a desired final shape of the can body, the pattern comprising inwardly extending portions that are less in diameter than the diameter of the sidewall of the can body blank and outwardly extending portions that are greater in diameter than the diameter of the sidewall of the can body blank; (c) positioning the can body blank within the mold cavity, whereby the can body blank is precompressed by the inwardly extending portions of the pattern in the mold wall; and (d) supplying a pressurized fluid into the mold cavity so that the can body blank is forced by pressure against the mold wall, causing the can body blank to assume the desired final shape of the can body, the precompression that is performed in step (c) minimizing the amount of outward deformation that is required to achieve the final shape of the can body.

According to a third aspect of the invention, a method of manufacturing a metallic can body that is shaped distinctively in order to enhance its visual presentation to consumers, includes steps of (a) providing a can body blank that has a sidewall that is of a substantially constant diameter; (b) providing a mold unit that has at least one mold wall that defines a mold cavity that is shaped generally like the can body blank, the mold wall having a pattern formed therein that corresponds to a desired final shape of the can body; (c) positioning the can body blank within the mold cavity; and (d) supplying a pressurized fluid into the mold cavity so that the can body blank is forced by pressure against the mold wall, causing the can body blank to assume the desired final shape of the can body.

According to a fourth aspect of the invention, a method of manufacturing a metallic can body that is shaped distinctively in order to enhance its visual presentation to consumers, comprising steps of: (a) making a can body blank that has a sidewall that is of a substantially constant diameter; (b) washing the can body blank; (c) drying the can body blank at a temperature that will partially anneal at least a portion of the can body blank, thereby giving the annealed portion of the can body blank increased ductility; (d) providing a mold unit that has at least one mold wall that defines a mold cavity that is shaped generally like the can body blank, the mold wall having a pattern formed therein that corresponds to a desired final shape of the can body; (e) positioning the can body blank within the mold cavity; and (f) supplying a pressurized fluid into the mold cavity so that the can body blank is forced by pressure against the mold wall, causing the can body blank to assume the desired final shape of the can body.

According to a fifth aspect of the invention, a system for manufacturing a metallic can body that is shaped distinctively in order to enhance its visual presentation to consumers, includes structure for making a can body blank that has a sidewall that is of a substantially constant diameter; molding structure comprising a mold unit that has at least one mold wall that defines a mold cavity that is shaped generally like the can body blank, the mold wall having a pattern formed therein that corresponds to a desired final shape of the can body, the pattern comprising inwardly extending portions that are less in diameter than the diameter of the sidewall of the can body blank and outwardly extending portions that are greater in diameter than the diameter of the sidewall of the can body blank; positioning structure for positioning the can body blank within the mold cavity, whereby the can body blank is precompressed by the inwardly extending portions of the pattern in the mold wall; and fluid supply structure for supplying a pressurized fluid into the mold cavity so that the can body blank is forced by pressure against the mold wall, causing the can body blank to assume the desired final shape of the can body, the precompression minimizing the amount of outward deformation that is required to achieve the final shape of the can body.

According to a sixth aspect of the invention, a system of manufacturing a metallic can body that is shaped distinctively in order to enhance its visual presentation to consumers, includes structure for making a can body blank that has a sidewall that is of a substantially constant diameter; molding structure comprising a mold unit that has at least one mold wall that defines a mold cavity that is shaped generally like the can body blank, the mold wall having a pattern formed therein that corresponds to a desired final shape of the can body; positioning structure for positioning the can body blank within the mold cavity; and fluid supply structure for supplying a pressurized fluid into the mold cavity so that the can body blank is forced by pressure against the mold wall, causing the can body blank to assume the desired final shape of the can body.

According to a seventh aspect of the invention, a system of manufacturing a metallic can body that is shaped distinctively in order to enhance its visual presentation to consumers includes structure for making a can body blank that has a sidewall that is of a substantially constant diameter; washing structure for washing the can body blank; drying structure for drying the can body blank at a temperature that will partially anneal at least a portion of the can body blank, thereby giving the annealed portion of the can body blank increased ductility; mold structure comprising a mold unit that has at least one mold wall that defines a mold cavity that is shaped generally like the can body blank, the mold wall having a pattern formed therein that corresponds to a desired final shape of the can body; positioning structure for positioning the can body blank within the mold cavity; and fluid supply structure for supplying a pressurized fluid into the mold cavity so that the can body blank is forced by pressure against the mold wall, causing the can body blank to assume the desired final shape of the can body.

According to an eighth aspect of the invention, a method of manufacturing a metallic can body that is shaped distinctively in order to enhance its visual presentation to consumers includes steps of (a) providing a can body blank that has a sidewall that is of a substantially constant diameter; (b) radially deforming the can body blank in selected areas by selected amounts to achieve an intermediate can body that is radially modified, but is still symmetrical about its axis; and (c) superimposing a preselected pattern of mechanical deformations that have an axial component onto the intermediate can body, whereby a distinctively shaped can body is produced that has both circumferential expansion components and axial components.

According to a ninth aspect of the invention, a system for manufacturing a metallic can body that is shaped distinctively in order to enhance its visual presentation to consumers includes structure for making a can body blank that has a sidewall that is of a substantially constant diameter; radial deforming structure for radially deforming the can body blank in selected areas by selected amounts to achieve an intermediate can body that is radially modified, but is still symmetrical about its axis; and axial deforming structure for superimposing a preselected pattern of mechanical deformations that have an axial component onto the intermediate can body, whereby a distinctively shaped can body is produced that has both circumferential expansion components and axial components.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
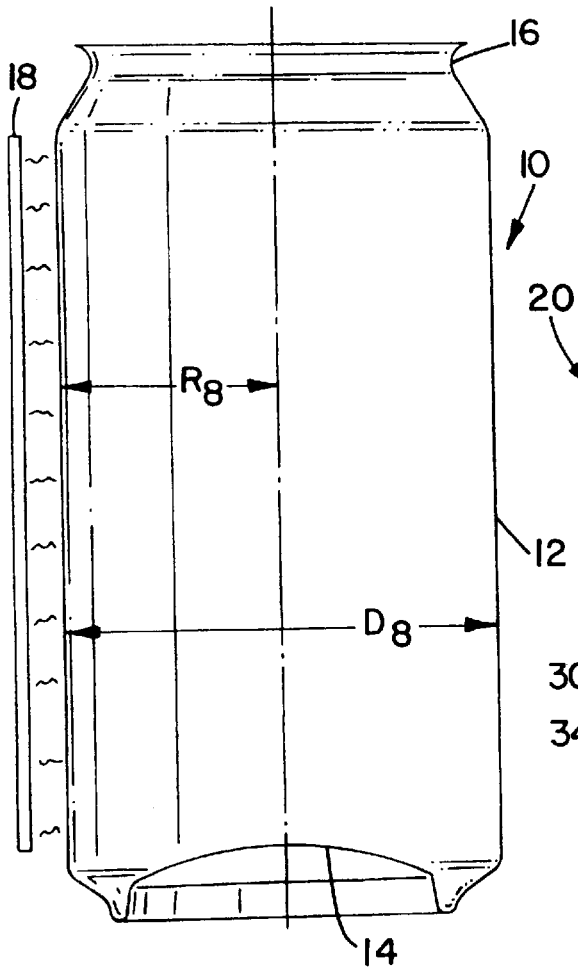
FIG. 1 is a cross-sectional view taken through a can body blank or pre-form that is constructed according to a preferred embodiment of the invention.
Figure 2:
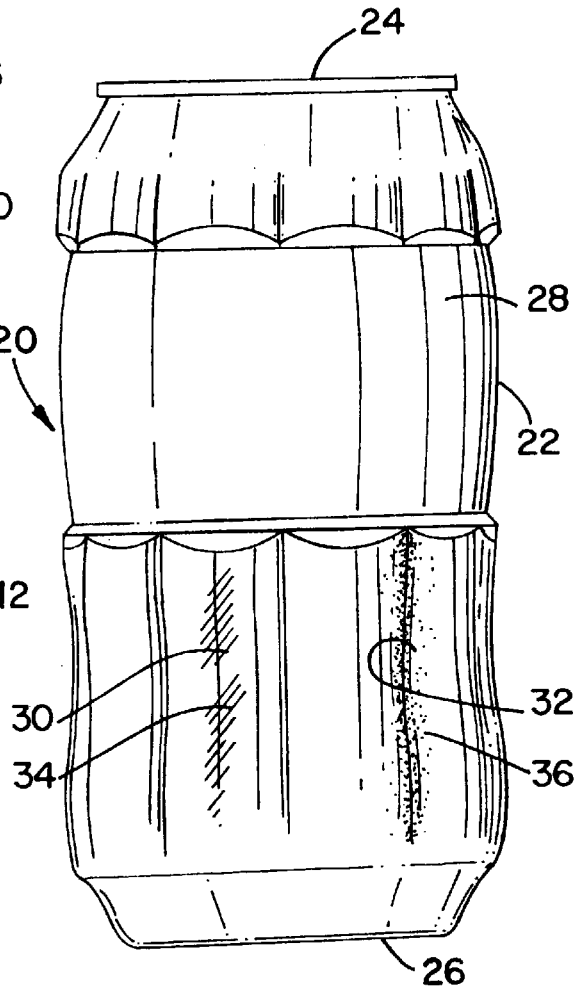
FIG. 2 is a side elevational view of a shaped can body according to a preferred embodiment of the invention.

Referring now to the drawings, wherein like reference numerals designate corresponding structure throughout the views, and referring in particular to FIGS. 1 and 2, a can body blank or preform 10 according to a preferred embodiment of the invention is the body of a two-piece can, which is preferably formed by the well-known drawing and ironing process. Alternatively, can body blank 10 could be formed by alternative processes, such as a draw-redraw process, a draw-thin-redraw process, or by a three-piece welded or cemented manufacturing process. Can body blank 10 includes a substantially cylindrical sidewall surface 12, a bottom 14, and necked upper portion 16. Alternatively, the upper portion of cylindrical sidewall 12 could be straight.

As is well known in this area of technology, the can body blank 10 must be washed after the drawing and ironing process, and then must be dried prior to being sent to the decorator. The drying process typically is performed at a temperature of about 250 degrees Fahrenheit. According to this invention, the drying is performed at a higher temperature than is ordinary to partially anneal at least selected portions of the can body blank 10. In FIG. 1, a heat source 18 is schematically depicted, which is preferably part of the dryer assembly, but could be at any point in the system prior to the molding unit. As will be discussed in greater detail below, can body blank 10 is preferably formed of aluminum and the partial annealing is preferably accomplished at a temperature that is substantially within the range of about 375 degrees Fahrenheit to about 550 degrees Fahrenheit, with a more preferred range of about 450 degrees Fahrenheit to about 500 degrees Fahrenheit, and a most preferred temperature of about 475 degrees Fahrenheit. This is in contrast to true annealing, which would be at temperatures over 650 degrees Fahrenheit. The purpose of the partial annealing is to give the can body blank 10 enough ductility to be formed into a configured can 20, such as is shown in FIG. 2 of the drawings.

Referring now to FIG. 2, shaped can 20 is decorated and shaped distinctively in order to enhance its visual presentation to consumers. As may be seen in FIG. 2, can body 20 includes a bottom 26, a shaped sidewall 22 that is configured to substantially deviate from the standard cylindrical can body shape, such as the shape of can body blank 10. The shaped sidewall 22 includes areas, such as ribs 30 and grooves 32, where accentuation of such deviations from the cylindrical shape might be desired. According to one important aspect of the invention, decoration is provided on the external surface of the shaped sidewall 22 in a manner that will accentuate those areas of the sidewall where accentuation of the deviation from the cylindrical shape is desired. As may be seen in FIG. 2, a first type of decoration, which may be a lighter color, is provided on the rib 30, while a second type of decoration 36, which may be a darker color, is provided within at least one of the grooves 32. By providing such selective decoration, and by properly registering the decoration to the deviations in the shaped sidewall 22, a synergistic visual effect can be obtained that would be impossible to obtain alone by shaping the can or by decorating the can.

Referring again to FIG. 2, shaped sidewall 22 also has a flat area 28, where writing or a label might be applied, and is capped with a can end 24, which is applied in the traditional double seaming process.

According to the preferred method, after the partial annealing by the heat source 18 at the drying station, can body blank 10 will be transported to a decorator, where the distinctive decoration will be applied while the can body blank 10 is still in its cylindrical configuration. Markers might also be applied during the decorating process that can be used for registration of the decoration to the mold contours during subsequent forming steps, which will be described in greater detail below.

Figure 3:
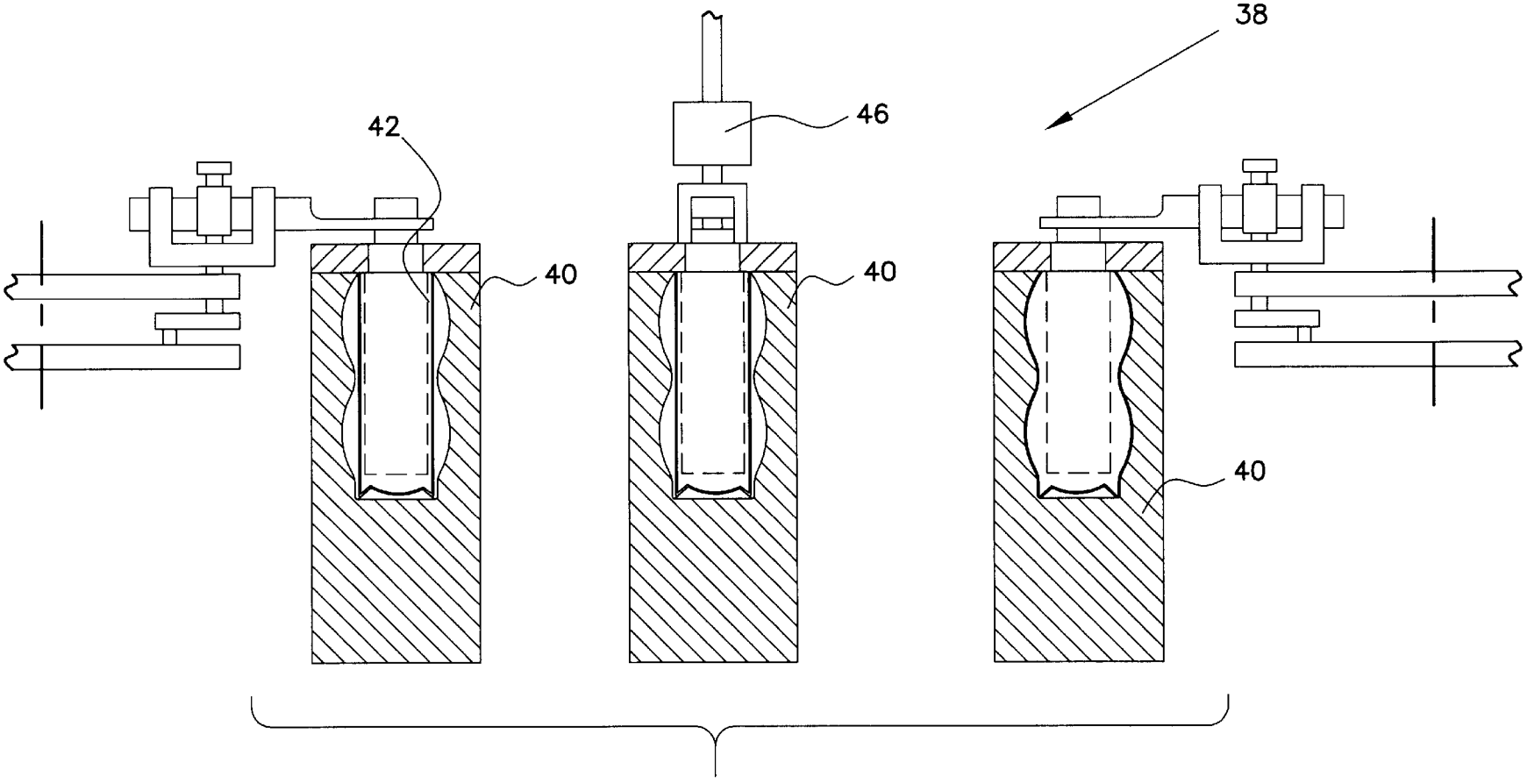
FIG. 3 is a diagrammatical view of a system for making a shaped can body according to a preferred embodiment of the invention.

Referring now to FIG. 3, a system 38 is depicted which, according to the preferred embodiment of the invention, is provided to manufacture a shaped can 20 of the type that is depicted in FIG. 2. As may be seen in FIGS. 3, 4 and 5, system 38 includes a number of mold units 40, each of which has at least one mold wall 46 that defines a mold cavity 42 that is shaped generally like the can body blank 10, but has a pattern formed therein that corresponds to the desired final shape of the shaped can body 20. As is shown diagrammatically in FIG. 6, this pattern will include inwardly extending portions 48 that are less in diameter than the diameter $D_b$ of the cylindrical sidewall 12 of the can body blank 10. The pattern on the mold wall 46 will also include a number of outwardly extending portions that are greater in diameter than the diameter $D_b$ of the sidewall 12 of the can body blank 10. In other words, the inwardly extending portions 48 tend to compress the cylindrical sidewall 12 of the can body blank 10, while the sidewall 12 of the can body blank 10 must be expanded to conform to the outwardly extending portions 50 of the mold wall 46.

Figure 4:
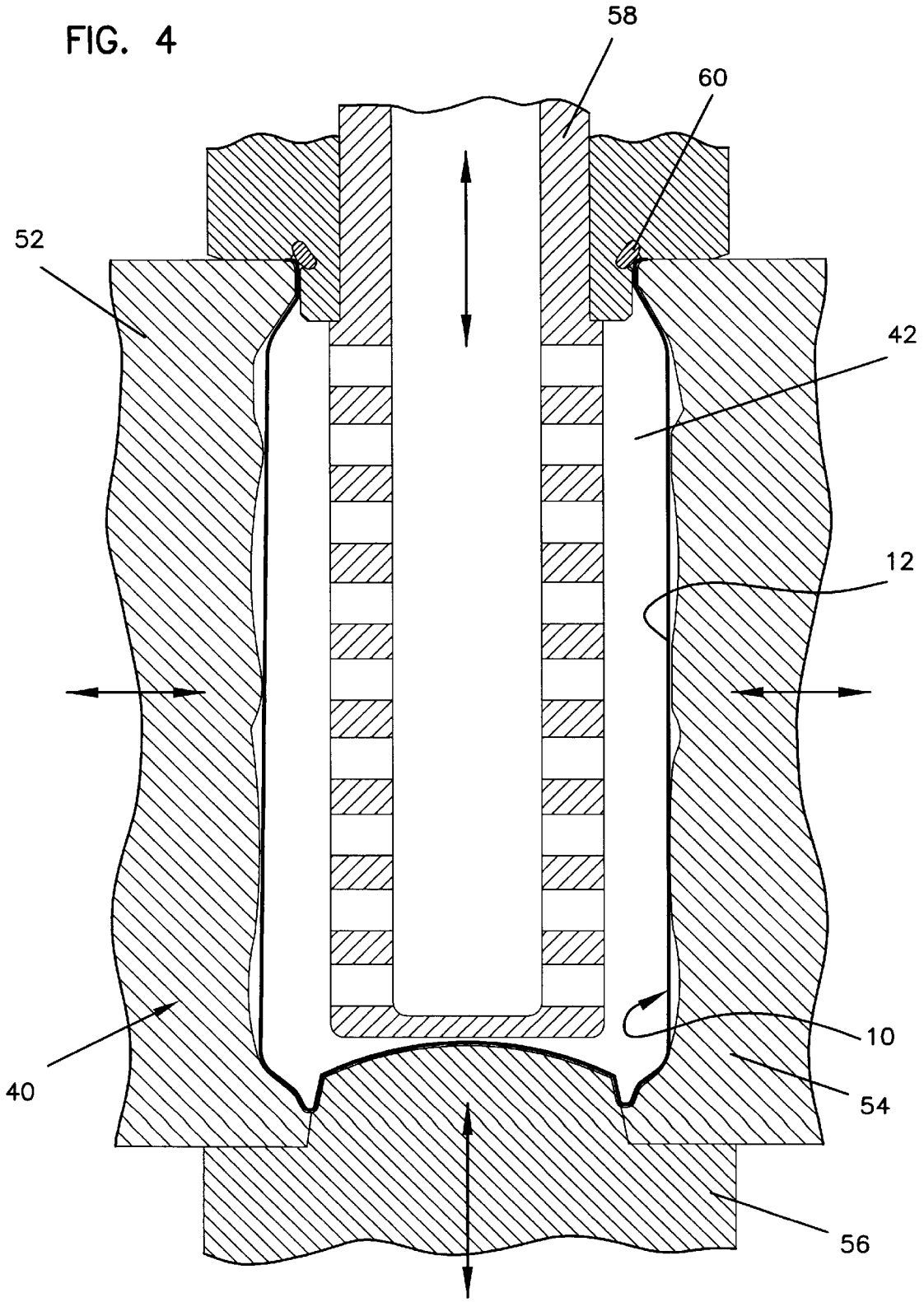
FIG. 4 is a cross-sectional view through a mold unit in the system depicted in FIG. 3, shown in a first condition.

As may best be seen in FIG. 4, the can body blank 10 is preferably positioned within the mold cavity 42 and its interior space is sealed into communication with a source of pressurized fluid, which is preferably compressed air. This is accomplished by closing a first mold half 52 and a second mold half 54 about the cylindrical sidewall 12 of the can body blank 10, with a can support 56 having a dome that is complementary to the bottom of the can body blank 10 defined therein. A gas probe 58 is brought into communication with the first and second mold halves 52, 54 so as to seal with respect thereto, which is accomplished by an o-ring 60 in the preferred embodiment shown in FIGS. 4 and 5.

Figure 5:
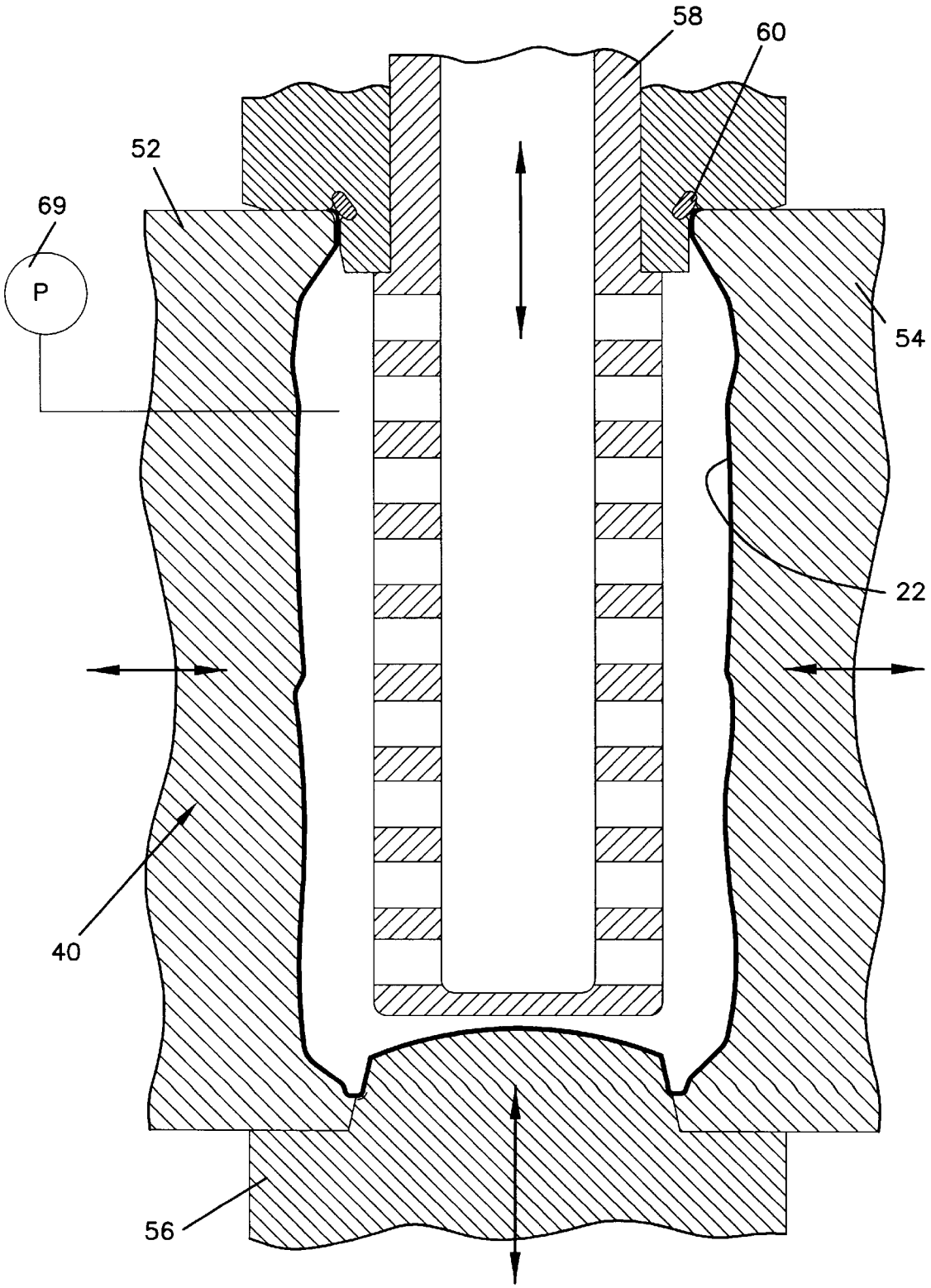
FIG. 5 is a cross-sectional view through a mold unit in the system depicted in FIG. 3, shown in a second condition.
Figure 6:
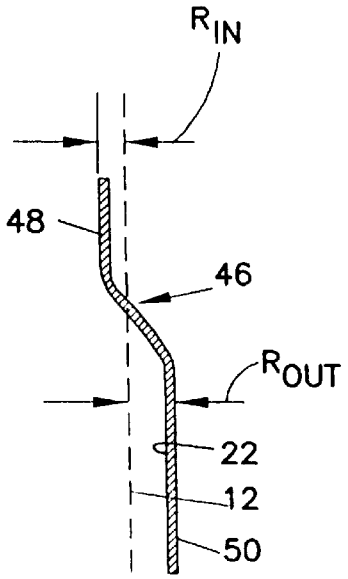
FIG. 6 is a diagrammatical depiction of a precompression step that is performed in the system as depicted in FIG. 3.

As the mold halves 52, 54 close about the cylindrical sidewall 12, the inwardly extending portions 48 of the mold wall 46 thus compress or precompress the cylindrical sidewall 12 by distances up to the amount $R_{in}$, shown in FIG. 6. After the mold has been closed and sealed, a pressurized fluid, preferably compressed air, is supplied into the mold cavity 46 so as to force the can body blank 10 against the mold wall 46, thereby causing the can body blank 10 to assume the desired final shape of the configured can 20. The state of the shaped sidewall 22 is shown after the step in FIG. 5. In this step, the cylindrical sidewall 12 of the can body blank 10 is expanded up to an amount $R_{out}$, again shown diagrammatically in FIG. 6.

Preferably, the precompression that is effected by the closing of the mold halves 52, 54 is performed to deflect the sidewall 12 of the can body blank 10 radially inwardly by a distance of $R_{in}$ that is within the range of about 0.1 to about 1.5 millimeters. More preferably, this distance $R_{in}$ is within the range of 0.5 to about 0.75 millimeters. The distance $R_{out}$ by which cylindrical sidewall 12 is radially expanded outwardly to form the outermost portions of the contoured sidewall 22 is preferably within the range of about 0.1 to about 5.0 millimeters. A most preferable range for distance $R_{out}$ is about 0.5 to 3.0 millimeters. Most preferably, $R_{out}$ is about 2 millimeters.

To understand the benefit that is obtained by the precompression of the cylindrical sidewall 12 prior to the expansion step, it must be understood that a certain amount of annealing or partial annealing is felt to be necessary, particular in the case of aluminum can bodies, to obtain the necessary ductility for the expansion step. However, the more complete the annealing, the less strong and tough the shaped can 20 will ultimately be. By using the precompression to get a significant portion of the differential between the innermost and outermost portions of the pattern that is superimposed onto the final shaped can 20, the amount of actual radial expansion necessary to achieve the desired pattern is reduced. Accordingly, the amount of annealing that needs to be applied to the can body blank 10 is also reduced. The precompression step, then, allows the desired pattern to be superimposed on the shaped can 20 with a minimum of annealing and resultant strength loss, thus permitting the cylindrical sidewall 12 of the can body blank 10 to be formed as thinly as possible for this type of process.

Preferably, the mold wall is formed of a porous material so as to allow air trapped between the sidewall of the can body blank and the moldwall to escape during operation. The most preferred material is porous steel, which is commercially available from AGA in Lidigo, Sweden.

For purposes of quality monitoring and control, fluid pressure within the mold cavity 46 is monitored during and after the expansion process by means of a pressure monitor 69, shown schematically in FIG. 5. Pressure monitor 69 is of conventional construction. If the can body develops a leak during the expansion process, or if irregularities in the upper flange or neck of the can creates a bad seal with the gas probe, pressure within the mold cavity will drop much faster in the mold chamber 46 than would otherwise be the case. Pressure monitor 69 will sense this, and will indicate to an operator that the can body might be flawed.

In the case of steel cans, pressure within the mold chamber could be made high enough to form the can body into, for example, a beading-type pattern wherein a bumber of circumferential ribs are formed on the container.

Figure 7:
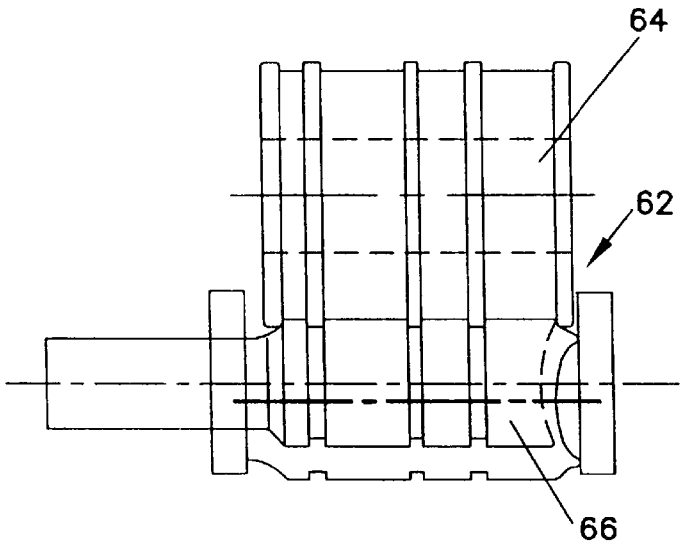
FIG. 7 is a diagrammatical depiction of a beading step in a method that is performed according to a second embodiment of the invention.
Figure 8:
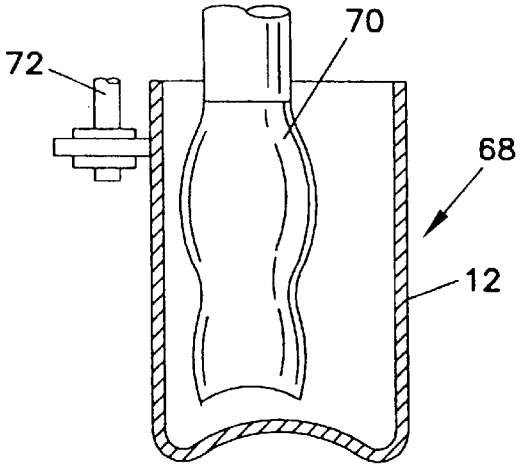
FIG. 8 is a diagrammatical depiction of a spinning step in a method that is performed according to a second embodiment of the invention.
Figure 9:
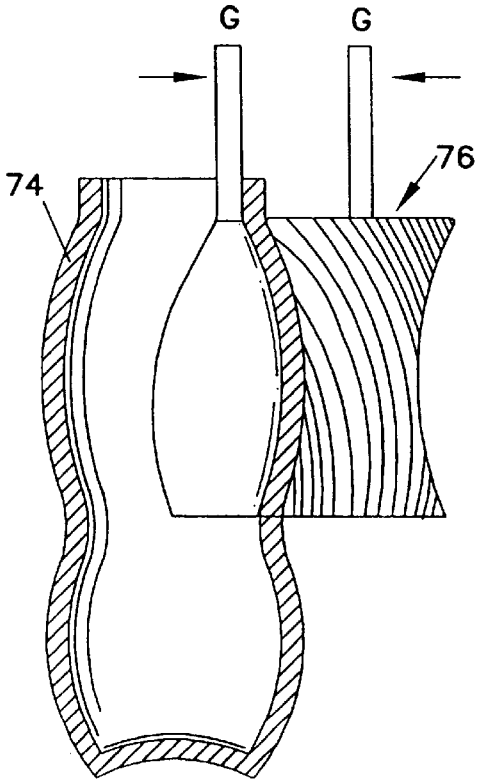
FIG. 9 is a diagrammatical depiction of a knurling step that can be performed as a second step in either the second or third embodiments of the invention referred to above.

A second method and system for manufacturing a metallic can body that is shaped distinctively in order to enhance its visual presentation to consumers is disclosed in FIGS. 7 and 9 of the drawings. A third embodiment is depicted in FIGS. 8 and 9 of the drawings. According to both the second and third embodiments, a distinctively shaped metallic can body is manufactured by providing a can body blank, such as the can body blank 10 shown in FIG. 1, that has a sidewall 12 of substantially constant diameter, than radially deforming the can body blank 10 in selective areas by selected amounts to achieve an intermediate can body 74 that is radially modified, but is still symmetrical about its access, and then superimposing a preselected pattern of mechanical deformations onto the intermediate can body 74. Describing now the second embodiment of the invention, a beading system 62 of the type that is well known in this area of technology includes an anvil 66 and a beading tool 64. A beading system 62 is used to radially deform the can body blank 10 into the radially modified intermediate can body 74 shown in FIG. 9. The intermediate can body 74, as may be seen in FIG. 9, has no deformations thereon that have an axial component, and is substantially cylindrical about the axis of the can body 74. A knurling tool 76 is then used to superimpose the preselected pattern of mechanical deformations, in this case ribs and grooves, onto the intermediate can body, making it possible to produce a shaped can 20 of the type that is shown in FIG. 2.

In the third embodiment, shown in FIGS. 8 and 9, a spinning unit 68 is used to deform the cylindrical sidewall 12 of the can body blank 10 radially into the intermediate can body 74. Spinning unit 68 includes, as is well known in the technology, a mandrel 70 and a shaping roller 72 that is opposed to the mandrel 70. After this process, the knurling step shown in FIG. 9 is preferably performed on the so formed intermediate can body 74 in a manner that is identical to that described above.

Alternatively to the knurling step shown in FIG. 9, the intermediate can body 74 produced by either the method shown in FIG. 7 or that shown in FIG. 8 could, alternatively, be placed in a pneumatic expansion die or mold unit 40 of the type that is shown in FIGS. 3–5. Intermediate can body 74 would then be expanded in a manner that is identical to that described above in order to achieve the shaped can 20.

In the second and third methods described above, the can body blank 10 is also preferably partially annealed by the heat source 18 during the drying process, but, preferably, to a lesser extent than that in the first described embodiment. Preferably, the annealing for the second and third methods described above is performed at a temperature that is within the range of about 375 degrees Fahrenheit to about 425 degrees Fahrenheit. The methods described with reference to FIGS. 7 and 8 thus require less annealing than that described with respect to the previous embodiment, meaning that a stronger shaped can 20 is possible at a given weight or wall thickness, or that the weight of the shaped can 20 can be reduced with respect to that produced by the first described method. Disadvantages of the second and third methods, however, include more machinery and greater mechanical complexity, as well as more wear and tear on the cans, spoilage and possible decoration damage as a result of the additional. mechanical processing and handling. It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of manufacturing a metallic can body that is shaped distinctively in order to enhance its visual presentation to consumers, comprising steps of:

(a) making a can body blank;

(b) partially annealing the whole of the can body blank at a temperature that is within the range of about 450 degrees Fahrenheit (232° C.) to about 500 degrees Fahrenheit (260° C.), thereby giving the partially annealed can body blank increased ductility;

(c) providing a mold unit that has at least one mold wall that defines a mold cavity conforming to a desired final shape of the can body;

(d) positioning said can body blank within said mold cavity; and (e) supplying a pressurized fluid into said mold cavity so that said can body blank is forced by pressure against said mold wall, causing said can body blank to assume the desired final shape of the can body.

2. A method according to claim 1, wherein said partial annealing step is performed at a temperature that is about 475 degrees Fahrenheit (246° C.).

3. A method according to claim 1, wherein step (b) is performed during drying of said can body blank.

4. An apparatus for manufacturing a metallic can body that is shaped distinctively in order to enhance its visual presentation to consumers, comprising:

means for making a can body blank;

means for partially annealing the whole of the can body blank at a temperature that is within the range of about 450 degrees Fahrenheit (232° C.) to about 500 degrees Fahrenheit (260° C.), thereby giving the partially annealed can body blank increased ductility;

mold means comprising a mold unit that has at least one mold wall that defines a mold cavity conforming to a desired final shape of the can body;

positioning means for positioning said can body blank within said mold cavity; and fluid supply means for supplying a pressurized fluid into said mold cavity so that said can body blank is forced by pressure against said mold wall, causing said can body blank to assume the desired final shape of the can body.

5. An apparatus according to claim 4, further comprising means for drying said can body blank, and wherein said partial annealing step is performed by said drying means at a temperature that is about 475 degrees Fahrenheit (246° C.).

6. An apparatus according to claim 4, wherein said means for partially annealing comprises a can body dryer.

7. A method of forming a metallic can body blank into a can body that is shaped distinctively in order to enhance its visual presentation to consumers, comprising steps of:

(a) washing the can body blank:

(b) simultaneously drying and partially annealing the whole of the can body blank at a temperature that is within the range of about 450° F. to about 500° F., thereby giving the dried and partially annealed can body blank increased ductility;

(c) positioning said dried and partially annealed can body blank within a mold cavity, said mold cavity having a wall conforming to at least a portion of a desired final shape of the can body; and (d) supplying a pressurized fluid into said can body blank so that said can body blank is forced by pressure against said mold wall, causing said can body blank to assume the desired final shape of the can body.

8. A method according to claim 7, wherein the step of simultaneously drying and partially annealing the whole of the can body blank comprises directing the washed can body blank to a dryer.

9. An apparatus for forming a washed metallic can body blank into a dry can body that is shaped distinctively in order to enhance its visual presentation to consumers, comprising:

(a) a dryer station for simultaneously drying and partially annealing the whole of the washed can body blank at a temperature that is within the range of about 450° F. to about 500° F., thereby giving the dried and partially annealed can body blank increased ductility;

(b) a mold having at least one mold wall that defines a mold cavity conforming to at least a portion of a desired final shape of the can body; and (c) a conduit for directing a pressurized fluid into said dried and partially annealed can body blank so that said can body blank is forced by pressure against said mold wall, thereby causing said can body blank to assume the desired final shape of the can body.

* * * * *

UNITED STATES PATENT AND TRADEMARK OFFICE

CERTIFICATE OF CORRECTION

PATENT NO. : 5,960,659
DATED : October 5, 1999
INVENTOR(S) : Mark W. Hartman et al.

It is certified that error appears in the above-identified patent and that said Letters Patent is hereby corrected as shown below:

Title page,
Item [56], References Cited, FOREIGN PATENT DOCUMENTS, please include the following omitted references:

| | | |
|---|---|---|
| -- 1 925 014 | 11/1970 | Germany |
| 2 131 811 | 12/1972 | Germany |
| 3 337 382 A1 | 04/1985 | Germany |
| 3 716 176 | 09/1988 | Germany |
| 94 11 461.7 | 09/1994 | Germany |
| P23 08 420.0 | 02/1973 | Germany |
| 64-2733 | 01/1989 | Japan |
| 57-44426 | 03/1982 | Japan |
| 61-255725 | 11/1986 | Japan |
| 62-199232 | 09/1987 | Japan |
| 63052721 | 03/1988 | Japan |
| 07124656 | 05/1995 | Japan |
| 7-165224 | 06/1995 | Japan |
| 613946 | 12/1983 | Japan |
| 613946-1 | 11/1985 | Japan |
| 724416 | 02/1988 | Japan |
| 724416-1 | 11/1988 | Japan |
| 727797 | 03/1988 | Japan |
| 748958 | 11/1988 | Japan |
| 907967 | 10/1994 | Japan |
| 932536 | 08/1995 | Japan --; |

UNITED STATES PATENT AND TRADEMARK OFFICE

CERTIFICATE OF CORRECTION

PATENT NO. : 5,960,659
DATED : October 5, 1999
INVENTOR(S) : Mark W. Hartman et al.

It is certified that error appears in the above-identified patent and that said Letters Patent is hereby corrected as shown below:

FOREIGN PATENT DOCUMENTS, cont'd.,
Delete "2 003 416" and insert -- 2 003 416A --;
"2 123 329" and insert -- 2 123 329A --;
"2 120 148" and insert -- 2 120 148B --;
"2 224 965" and insert -- 2 224 965A --;
"2 257 073" and insert -- 2 257 073A --;
"2 266 290" and insert -- 2 266 290A --.

Signed and Sealed this

Seventeenth Day of August, 2004

JON W. DUDAS
*Acting Director of the United States Patent and Trademark Office*